US010427201B2

(12) United States Patent
Bungter et al.

(10) Patent No.: US 10,427,201 B2
(45) Date of Patent: Oct. 1, 2019

(54) HANDHELD PRESSING DEVICE

(71) Applicant: Novopress GmbH Pressen und Presswerkzeuge & Co. KG, Neuss (DE)

(72) Inventors: Martin Bungter, Monchengladbach (DE); Jörg Hanisch, Wuppertal (DE); Günther Odenthal, Monchengladbach (DE)

(73) Assignee: Novopress GmbH Pressen und Presswerkzeuge & Co. KG, Neuss (DE)

( * ) Notice: Subject to any disclaimer, the term of this patent is extended or adjusted under 35 U.S.C. 154(b) by 850 days.

(21) Appl. No.: 14/771,675

(22) PCT Filed: Feb. 14, 2014

(86) PCT No.: PCT/EP2014/052884
§ 371 (c)(1),
(2) Date: Aug. 31, 2015

(87) PCT Pub. No.: WO2014/131627
PCT Pub. Date: Sep. 4, 2014

(65) Prior Publication Data

US 2016/0016222 A1 Jan. 21, 2016

(30) Foreign Application Priority Data

Mar. 1, 2013 (DE) ..... 10 2013 203 553

(51) Int. Cl.
*B21D 39/04* (2006.01)
*B25B 27/10* (2006.01)
(Continued)

(52) U.S. Cl.
CPC ..... *B21D 39/048* (2013.01); *B25B 27/10* (2013.01); *H01R 43/042* (2013.01);
(Continued)

(58) Field of Classification Search
CPC . B21D 39/048; B25B 27/10; Y10T 29/49925; Y10T 29/49934; Y10T 29/49936; H01R 43/042; H01R 43/0428
(Continued)

(56) References Cited

U.S. PATENT DOCUMENTS 5,903,462 A * 5/1999 Wagner ..... G05D 17/02 318/490
6,164,106 A 12/2000 Nghiem et al.
(Continued)

FOREIGN PATENT DOCUMENTS

DE 19631019 A1 8/1997
DE 20317913 U1 2/2004
(Continued)

OTHER PUBLICATIONS

Novopress GMBH; DE 10354166; Method for documentation of compression connection of tubes e.g. water pipes with appliance and press-specific data related to one pressing stage collected and shown on e.g. printed labels; EPO English Machine Translation; Feb. 21, 2018; pp. 1-3.*

*Primary Examiner* — Bayan Salone
(74) *Attorney, Agent, or Firm* — The Webb Law Firm

(57) ABSTRACT

A handheld pressing device for connecting two work pieces, in particular a pipe and a press fitting by means of a pressing process, has a pressing tool with multiple pressing jaws. The pressing tool is connected to a converter driven by an electric motor. The electric motor and the converter are partly surrounded by a housing. The pressing device has at least one data detecting element, at least one data detecting element being a camera. Furthermore, the camera is used as a data detecting element for documenting pressing processes in a method.

35 Claims, 6 Drawing Sheets

(51) Int. Cl.
*H01R 43/04* (2006.01)
*H01R 43/042* (2006.01)

(52) U.S. Cl.
CPC .... *H01R 43/0428* (2013.01); *Y10T 29/49925* (2015.01); *Y10T 29/49934* (2015.01); *Y10T 29/49936* (2015.01)

(58) Field of Classification Search
USPC ..... 29/515, 520, 521
See application file for complete search history.

(56) References Cited

U.S. PATENT DOCUMENTS 6,202,290 B1 * 3/2001 Kewitz ..... B21D 39/046 29/508
8,255,070 B2 * 8/2012 Gamboa ..... B25B 21/00 235/375
9,229,232 B2 * 1/2016 Backhaus ..... B25B 23/1425
9,233,458 B2 * 1/2016 Schmidt ..... B25B 21/02
2010/0228632 A1 * 9/2010 Rodriguez ..... G06F 3/011 705/14.66
2011/0040831 A1 * 2/2011 Payne ..... G06Q 10/10 709/203
2011/0082576 A1 4/2011 Gamboa et al.
2011/0279479 A1 * 11/2011 Rodriguez ..... G06F 3/011 345/633
2012/0222876 A1 * 9/2012 Schmidt ..... B25B 21/02 173/1
2013/0137079 A1 * 5/2013 Kahle ..... G01C 15/00 434/365
2013/0138466 A1 * 5/2013 Kahle ..... G06Q 10/063114 705/7.15
2014/0139406 A1 5/2014 Backhaus

FOREIGN PATENT DOCUMENTS

DE 10354166 A1 * 6/2005 ..... B25B 27/10
DE 102007005837 A1 8/2007
DE 102007035206 A1 1/2009
DE 202011004653 U1 6/2011
DE 202012104427 U1 11/2012
WO WO-2014131627 A1 * 9/2014 ..... B21D 39/048

* cited by examiner

| Consec. No. | Idle speed | Cut-off speed | Accum. voltage | Duty cycle | Force cycle | Temp. °C | Error code |
|---|---|---|---|---|---|---|---|
| 413 | 17281 | 10752 | 17,3 | 4,5 | 0,8 | 25,2 | 0x0000 |
| 412 | 0 | 0 | 0,0 | 0,0 | 0,0 | -50,0 | 0x0800 |
| 411 | 18726 | 13525 | 19,0 | 4,1 | 0,7 | 24,7 | 0x0000 |
| 410 | 18750 | 13380 | 19,0 | 4,1 | 0,7 | 24,7 | 0x0000 |
| 409 | 0 | 0 | 0,0 | 0,0 | 0,0 | -50,0 | 0x0800 |
| 408 | 14970 | 8094 | 15,0 | 5,4 | 1,0 | 23,7 | 0x0800 |
| 407 | 12458 | 0 | 0,0 | 0,8 | 0,0 | 25,2 | 0x0001 |
| 406 | 12366 | 0 | 0,0 | 0,2 | 0,0 | 25,2 | 0x0001 |
| 405 | 12406 | 0 | 0,0 | 0,2 | 0,0 | 24,7 | 0x0001 |
| 404 | 14822 | 0 | 0,0 | 0,4 | 0,0 | 24,7 | 0x0001 |
| 403 | 14925 | 0 | 0,0 | 0,3 | 0,0 | 24,7 | 0x0001 |
| 402 | 12335 | 0 | 0,0 | 0,2 | 0,0 | 26,1 | 0x0001 |
| 401 | 12345 | 0 | 0,0 | 0,2 | 0,0 | 26,6 | 0x0001 |
| 400 | 12406 | 0 | 0,0 | 0,2 | 0,0 | 26,6 | 0x0000 |
| 399 | 15673 | 9140 | 15,7 | 5,1 | 1,0 | 24,7 | 0x0999 |
| 398 | 13239 | 0 | 0,0 | 0,9 | 0,0 | 23,2 | 0x0001 |
| 397 | 13227 | 0 | 0,0 | 0,9 | 0,0 | 22,7 | 0x0000 |

| Consec. No. | Idle speed | Cut-off speed | Accum. voltage | Duty cycle | Force cycle | Temp. °C | Error code |
|---|---|---|---|---|---|---|---|
| 413 | 17281 | 10752 | 17,3 | 4,5 | 0,8 | 25,2 | 0x0000 |
| 412 | 0 | 0 | 0,0 | 0,0 | 0,0 | -50,0 | 0x0800 |
| 411 | 18726 | 13525 | 19,0 | 4,1 | 0,7 | 24,7 | 0x0000 |
| 410 | 18750 | 13380 | 19,0 | 4,1 | 0,7 | 24,7 | 0x0000 |
| 409 | 0 | 0 | 0,0 | 0,0 | 0,0 | -50,0 | 0x0800 |
| 408 | 14970 | | | | 1,0 | 23,7 | 0x0800 |
| 407 | 12458 | | | | 0,0 | 25,2 | 0x0012 |
| 406 | 12366 | | | | 0,0 | 25,2 | 0x0001 |
| 405 | 12406 | | | | 0,0 | 24,7 | 0x0001 |
| 404 | 14822 | | | | 0,0 | 24,7 | 0x0001 |
| 403 | 14925 | | | | 0,0 | 24,7 | 0x0001 |
| 402 | 12335 | 0 | 0,0 | 0,2 | 0,0 | 26,1 | 0x0001 |
| 401 | 12345 | 0 | 0,0 | 0,2 | 0,0 | 26,6 | 0x0001 |
| 400 | 12406 | 0 | 0,0 | 0,2 | 0,0 | 26,6 | 0x0000 |
| 399 | 15673 | 9140 | 15,7 | 5,1 | 1,0 | 24,7 | 0x0999 |
| 398 | 13239 | 0 | 0,0 | 0,9 | 0,0 | 23,2 | 0x0001 |
| 397 | 13227 | 0 | 0,0 | 0,9 | 0,0 | 22,7 | 0x0000 |

HANDHELD PRESSING DEVICE

CROSS-REFERENCE TO RELATED APPLICATIONS

This application is the United States national phase of International Application No. PCT/EP2014/052884 filed Feb. 14, 2014, and claims priority to German Patent Application No. 10 2013 203 553.5 filed Mar. 1, 2013, the disclosures of which are hereby incorporated in their entirety by reference.

BACKGROUND OF THE INVENTION

Field of the Invention

The invention relates to a handheld pressing device, as well as to a method for quality assurance.

Description of Related Art

For the purpose of joining pipes handheld pressing devices are used. In preparation of the pressing, a press fitting is slipped on the pipe ends and is then compressed by means of the pressing device, wherein both the press fitting and the pipe end are plastically compressed. The pressing devices used for this purpose are known in various embodiments, with DE 10 2007 005 837.5, for example, being mentioned here as the only reference. The pressing devices include a pressing tool with at least two or more pressing jaws that approach each other during the pressing operation and crimping the press fitting together with the pipe ends. Most often, the pressing tool is exchangeable and is connected to the drive unit via a holding element. The drive unit of one type of such pressing devices has an electro-hydraulic drive which substantially consists of an electric motor and a connected converting means that converts the movement of the electric motor into the closing movement of the pressing tool. The converting means and the electric motor are usually situated in a common housing. The electric motor is driven by current from an accumulator unit.

SUMMARY OF THE INVENTION

Such pressing devices are used in particular to install water pipelines in buildings. Especially in larger buildings a great number of pressing operations occurs. In order to determine liabilities for an improper pressing in case of guarantee claims, DE 103 54 166 proposes a method for capturing data specific to a device, a press joint and an operation.

When such a pressing device is used, internal data are captured for each single pressing operation, but it is difficult to subsequently associate individual press joints to the respective press fittings used and to the pressing sites. Specifically, it is necessary to perform a visual inspection to control the pressing operation. However, this is inconvenient to realize in areas that have been obstructed subsequently or are difficult to access.

Further, it is not immediately obvious to the user of the pressing device whether the pressing device functions without problems. In the event of a fault this may sometimes cause erroneous data to be captured and stored. Thus, stored data are only conditionally suited to document a proper pressing operation. Faulty pressing operations should be discernible as such by a user. In particular, a user should be able to check the proper functionality of the pressing device and to document the same for later evidence.

It is an object of the present invention to provide a pressing device with which a simple and reliable check of the pressing operation can be performed and documented.

The present handheld pressing device for joining a pipe with a press fitting by a pressing operation includes a pressing tool with a plurality of pressing jaws. The pressing tool is driven by an electric motor with interposition of a converting device. The electric motor may be supplied with power from an accumulator unit. Specifically, the converting means is an electro-hydraulic or electro-mechanic converting device. According to the invention, the pressing device includes at least one data capturing element, preferably, however, a plurality of data capturing elements. At least one of the data capturing elements is a camera, in particular a CCD chip with lens elements.

By providing a camera on a pressing tool it is possible to optically capture data specific to press joints, devices or users. The optically captured data can be evaluated at any later time. In this regard, optically captured data have the advantage provided by the present invention that they are difficult to manipulate and can thus be used as evidence.

In a preferred embodiment the camera is oriented such that it captures the pressing tool. In this manner it is possible at a later time to unambiguously identify the pressing tool used. Preferably, the pressing tool has a distinguishing mark that is captured by the camera. This allows for a simplified identification of the pressing tool and even an automated identification of the pressing tool may be realized. Suitable distinguishing marks are, in particular, color marks, special characters or also barcodes or QR codes. In particular the latter two distinguishing marks allow for a simple identification of the pressing tool used.

In another embodiment a camera is oriented such that it captures the gap between the pressing jaws of the pressing tool. This may be the same camera that also captures the pressing tool. However, a second data capturing element may be provided in the form of an additional camera. The gap between pressing jaws gives information about the pressing operation. Specifically, a closed gap corresponds to a closed pressing tool. For a pressing tool suited for a press fitting, a closed gap of the pressing tool proves that the pressing operation has been performed to the end and has been completed. Thus, capturing the gap between the pressing jaws is a suitably means for assuring the quality of the pressing. Preferably, marks are provided on each individual pressing jaw, which can be captured easily by the camera and, in particular, have a high contrast. This facilitates a subsequent evaluation or allows for an automated evaluation. The marks may be stuck-on arrows of a high-contrast color and passive or active lighting elements or the like.

In a preferred development the pressing device includes a further camera or the existing camera is oriented such that the press fitting or a distinguishing mark applied thereto may be captured. As already described above, the distinguishing mark may be a color mark, a lettering, a barcode or a QR code. It is thereby possible to unambiguously identify the press fitting used.

An optical identification of the used pressing tool and the used press fitting offers the advantage provided by the invention that it is optically captured and can thereby be documented that it is possible to compress the press fitting used in a suitable manner, especially completely, by means of the pressing tool used.

In a particular embodiment a data capturing element is configured as a RFID (Radio Frequency Identification)

reader. In particular, the pressing tool has a RFID element that can be read out by the RFID reader of the pressing device. It is thereby possible to clearly and unambiguously identify the pressing tool. Preferably, also the work piece and, particularly preferred, also the press fitting have a RFID element so that the work piece and/or the press fitting can be unambiguously identified by the RFID readers of the pressing device.

Due to the identification of the pressing tool and the simultaneous identification of the work piece or the press fitting by means of the RFID identification it is also ensured that the pressing tool is suited for joining the work piece and the press fitting in an appropriate manner, in particular completely, by pressing.

It is further conceivable to identify the pressing device itself by an RFID element that can be read out by an external RFID reader so that a pressing device can be associated with specific press joints.

Preferably the camera and/or the RFID reader and, as is particularly preferred, all data capturing elements are arranged in the housing of the pressing device and are thereby integral parts of the pressing device itself. Thereby, the handling is facilitated and the data capturing elements are protected by the housing of the pressing device.

In particular, the pressing device may include an internal display device and/or an internal memory device to display the data captured at the pressing device or to store them in the pressing device. Storing allows the data captured to be read out and to be used at a later time. It is preferred that the pressing device in particular has a transmission unit that may be connected to an external memory device, an external evaluation device and/or an external display device so as to transmit the data capture. In this context it is particularly preferred that the data captured are transmitted onto an external memory device, an external evaluation device and an external display device. However, it is also possible to merely transmit the captured data onto an external memory device and/or an external display device so that the evaluation is carried out by the user himself. With respect to transmission it is particularly preferred that the connection can be established wirelessly by means of WLAN, Bluetooth, infrared transmission or another suitable radio transmission. As such, no connection by wire is required, whereby mobile working becomes possible. Further, no cable connection on the housing is required that would allow the ingress of dirt into the housing.

A capturing of date that serves to document a pressing operation and can be used as evidence has to be carried out independent of the user. In this regard, the invention provides that the motor control triggers the data capturing. In particular if the gap between the pressing jaws is captured to prove that the pressing has been completed, the motor control triggers the data capturing at the end of a pressing operation.

Moreover, the invention includes a method for the documentation of pressing operations for later use as evidence. For this purpose, the pressing tool includes at least one data capturing element, wherein the at least one data capturing element is configured as a camera. For the documentation of pressing operations, the documentation capturing is started. During each pressing the data capturing element captures data specific to the device and/or the pressing and/or the user. The data captured are stored in a memory means and are associated to a defined pressing operation. It is thus possible at a later time to prove the pressing operation and the proper execution thereof. Specifically, it is possible that the data capturing is started automatically with each single pressing operation or, as an alternative, upon activation of the pressing device so as to capture the respective pressing operations.

Specifically, the pressing tool is captured by the camera as the data specific to the pressing operation. On the one hand it is thereby possible to identify the pressing tool used. However, it is also possible to retroactively check the proper condition of the pressing tool by means of the optical capturing. In addition or as an alternative, the camera may capture the gap between the pressing jaws of the pressing tool. If the pressing tool is used correctly and a suitable combination of a pressing tool and a press fitting is used, the gap between the pressing jaws only closes if the pressing operation has been executed completely. Thus, by optically capturing of the gap between the pressing jaws, it can be proven subsequently that the required pressing force has been reached and the pressing operation has been executed, in particular completely. In addition or as an alternative, the camera may also capture the work piece after the pressing operation. Thus, the optical capturing makes it possible to perform a visual check of the press joint at a later time. This is particularly advantageous if the pressing operation has been performed at a site that is difficult to access and a subsequent check can be performed at the site only with difficulty. Moreover, the pressing tool, the work piece, specifically formed by the press fitting and a pipe, and/or the gap between the pressing jaws may bear marks facilitating optical identification. Specifically, the marks may be color marks, characters or the like. Preferably, the marks are designed as QR codes or barcodes, thereby allowing an automatic identification by the camera.

In a development, the method provides that user-specific data are captured by the camera. In particular, this relates to the user of the pressing device. The same may be captures optically by the camera so that an image is documented for later identification. The user may also be identified by optically capturing an individualized barcode and/or QR code.

The identification of the user may be used in particular to determine whether the user is authorized to use the pressing device. This results in a protection against theft and inappropriate handling.

In a preferred development of the method a pressing device is used that includes more than one data capturing element. Specifically, the pressing device includes a plurality of data capturing elements.

The data capturing elements allow the capturing of device-specific data, in particular the type number and/or the serial number of the pressing device, the type number, the serial number and/or the nominal size of a pressing tool of the pressing device, and/or control data relating to the pressing device, such as operation time, operation temperature, accumulator voltage, number of pressing operations performed and/or control data relating to the pressing tool.

Preferably, the data capturing elements capture as the pressing-specific data for each pressing operation the date and/or the time of the pressing operation, the pressing duration, the pressing path, the maximum pressing force or the cut-off speeds of the motor, the path of the pressing force over the pressing path, and/or data about whether a proper pressing was made or not, these data being stored in a memory device and associated to a defined pressing operation.

As the user-specific data, the data capturing elements capture in particular a name or an individualized code.

In particular, all or only a selection of the data captured is stored. In this regard, the storing is preferably performed automatically and does not have to be done by the user. Thereby, it is possible, based on the data captured, to obtain a reliable documentation and thus a proof for each individual pressing operation. The documentation should be configured to be tamper-proof so as to prevent subsequent changes by a user. Tamper protection is also obtained, inter alia, by the automatic capturing of the data during each and every pressing operation.

In a further development of the method, the pressing device includes a RFID reader which captures data for the documentation of pressing operations. It is possible to thereby identify and capture in particular the pressing tool or the press fitting.

The pressing device preferably includes a GPS sensor or an alternative positioning element operating via mobile radio or WLAN, the sensor capturing, as the pressing-specific data, the site of the pressing for the documentation of the pressing operation.

For the method it is preferred that the memory device is arranged in the pressing device. Preferably, in this case, the pressing device has a transmitter means in order to transmit the data captured to an external memory device in particular in a wireless manner via WLAN, infrared link, Bluetooth or a radio link. In particular, the captured data may be displayed on an internal display device at the device, but it is preferred that the external memory device is connected to an external display device to display the captured data on the external display device. However, it is also possible that the data are only stored in the memory device of the pressing device and can only be displayed on an external display device. In this case, the captured data are not stored on an external memory device. As an alternative it is nevertheless also possible that the data are not stored in the pressing device, but are transferred to an external memory device immediately after having been captured. Preferably, this transmission is a wireless transmission. Also in the case where the captured data are stored exclusively on an external memory device, the captured data may be displayed on an external display device.

It is particularly preferred to combine the external memory device and the external display device into a common device. This common device may in particular be a laptop computer, a tablet PC or a smart phone. As provided by the invention this offers the advantage of a simple operation, while at the same time enabling a high degree of portability.

In order to achieve a reliable pressing it is necessary to ensure the proper functionality of the pressing device. A functionality check is usually performed only by the device manufacturer. As a consequence the user of the pressing device may possible not be able to judge whether the pressing device functions properly. Since a defective pressing device results in a defective pressing, the invention includes a method for checking the proper functionality of a handheld pressing device, which may in particular be performed by the user. In the method, a checking cycle is started, whereby data are captured by in particular internal data capturing elements and the captured data are then displayed on an in particular external display device. Thus, the user can see internal data via the checking device, whereby the user is enabled to judge the functionality of the pressing device. Specifically, the pressing device is a pressing device as described above.

Specifically, the data captured are the number of operating hours, the number of the pressing operations performed, the current temperature in the pressing device and/or the current voltage of the accumulator unit. The data captured may be the entirety of all data mentioned or only a selection thereof.

In a further development of the method an evaluation is performed based on the data. This evaluation is preferably also displayed on a display device. The evaluation provides the user with concrete information about the proper functionality of the pressing device. Here, a judging of the displayed captured data by the user is no longer required, whereby, according to the invention, an erroneous judgment of the proper functionality of the pressing device is excluded. In this regard, in particular for evaluation purposes, the captured data are compared to respective predetermined value ranges. If the captured data do not fall within the predetermined value range, an error is generated. In this context it is possible, for example, that the manufacture predefines an operation temperature. If the detected temperature in the pressing device is not within this predetermined range, an error is displayed.

If an error has been generated by the evaluation, the same is preferably displayed by the in particular external display device so that the user may immediately see which error has occurred.

Specifically, the position of the holding element is captured in this method. If an evaluation follows, the position of the holding element is compared to a predetermined position. If these positions do not coincide, an error is generated and preferably displayed. In particular, the user is prompted to check or reinstall the holding element in order to remove the error.

During a further possible check the motor speed without load and in particular the functionality of the rotary speed sensor are detected. For an evaluation, the pressing device is started without pressing tool. Here, the correct functioning and the signal quality of the rotary speed sensor, as well as the motor speed are detected and compared to a set rotary speed. If the required rotary speed is not reached, the user is provided by this check and the subsequent evaluation with the information that the rotary speed sensor is defective. With a defective rotary speed sensor no proper pressing can be performed. Moreover, the pressing tool and the work piece may be damaged, since the detected rotary speed is used in de-energizing the electric motor at the end of the pressing operation. If no de-energizing occurs, damage will result. Further, the rotary speed thus detected may in particular be displayed as an idle speed.

For checking purposes, the method specifically provides to detect the pressing force and/or the path thereof during a pressing operation. In particular for evaluation purposes, a pressing tool is mounted in the pressing device and a pressing operation is performed with the pressing device. During the pressing operation the rotary speed and/or the current flow and/or the hydraulic pressure in the electro-hydraulic converting means are detected with respect to time. The pressing force can be determined from these data. The pressing force determined is compared to a predetermined path. As an alternative it is possible to compare both the detected rotary speed and the detected current flow or the hydraulic pressure to a predetermined path, respectively. If the data thus obtained or determined do not fall within a range about the predetermined path, an error is generated. This error is preferably displayed by the display device. The display device is preferably designed as an external display device. By checking the pressing force, the user immediately obtains information about whether the pressing device is able to generate the required pressing force. In particular, it is thereby ensured that the pressing device is able to join the press fitting and the pipe in a safe and reliable manner.

In a further development of the method the functionality of one or a plurality of status lights is checked, the lights being provided on the pressing tool and being designed in particular as LEDs. For this purpose the status lights are energized, and it is detected via a user dialogue, but preferably via a control of the current flow, whether current flows through the status lights. If no current is detected, an error is generated which is preferably displayed on the display means. It can thereby be ensured that the status lights function properly. It is likewise possible to check the functionality of the operating element by means of a current flow check. If the current flow control detects no current when the operating element is operated, an error is generated that is preferably displayed on the display device.

In a preferred development of the method the pressing device has an internal memory device on which the captured data are stored. In particular, it is still possible to transmit the captured data onto the external display device. Here, the transmission may be made via a wired connection, but it is preferably realized in a wireless manner via WLAN, Bluetooth, infrared transmission or radio transmission. The captured data may also be transmitted onto an external evaluation device and/or an external memory device, which is preferably also possible in a wireless manner.

In this regard it is particularly preferred that the external display device, the evaluation device and/or the memory device are combined into a common device. If the data are stored on an external memory device, it is alternatively possible to omit a memory device in the pressing device. In this case, the data are transmitted, preferably in a wireless manner, directly and stored exclusively in the external memory device during the individual checks. Moreover, it is particularly preferred if the evaluation generated by the evaluation device can be displayed on the same display device as the captured data, in particular on the external display device of the common device. This common device may in particular be a laptop computer, a tablet PC or a smart phone. As provided by the invention this offers the advantage of a simple operation, while at the same time enabling a high degree of portability.

In a development, the captured data may be transmitted onto an external transmitter unit linked to the manufacturer of the pressing device via the Internet. After transmission of the captured data to the manufacturer, the evaluation is made on the side of the manufacturer himself. This allows the manufacturer to perform a remote diagnosis and, in particular, to perform a remote error correction. Further, the captured data can thus be stored for safe access so that they may be used as evidence if needed at a later time.

BRIEF DESCRIPTION OF THE DRAWINGS

The following is a detailed description of the invention with reference to a preferred embodiment and to the accompanying drawings.

In the Figures.

DESCRIPTION OF THE INVENTION

Figure 1:
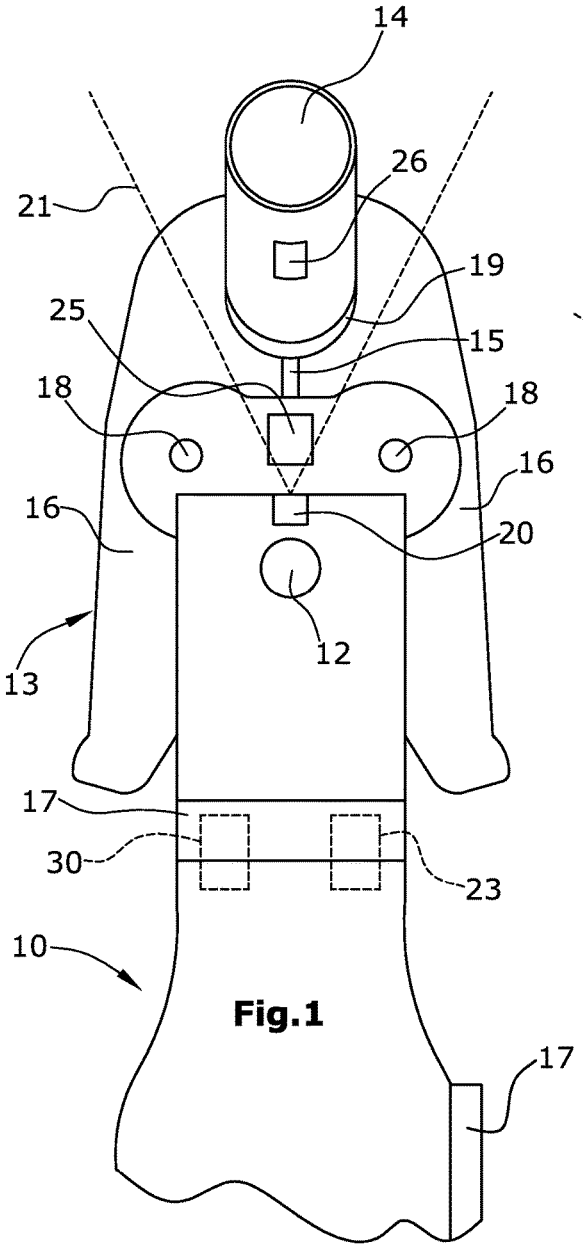
FIG. 1 is a side elevational view of a pressing device.

The present handheld pressing device for joining two work pieces includes a drive unit 10. This drive unit 10 is constituted by an electric motor supplied with current from an accumulator unit, and a converting device driven by the electric motor. The electric motor and the converting device are enclosed by the same housing. The pressing device is controlled via an operating element 17. Further, the pressing device includes a pressing tool 13 that is connected with the drive unit via a holding element 12. In a pressing operation, the pressing jaws 16 of the pressing tool 13 are pressed apart at the rear part, i.e. on the side facing the drive unit. Thereby, the pressing jaws 16 are pivoted about the pivot pins 18 so that the pressing jaws 16 approach each other at the front part, i.e. on the side averted from the drive unit. Thereby, a compression is achieved. Due to the pressing movement of the pressing tool 13, a press fitting 19 is joined with a pipe end 14 by pressing and is thus joined with the same in a reliable and tight manner.

According to the invention the pressing device includes a camera 20. The image area 21 of the camera is oriented such that the camera simultaneously captures the pressing tool 13, the pipe end 14 and the press fitting 19. This allows an optical identification of the pressing tool 13, the press fitting 19 and the pipe 14 used. Further, as can be seen in FIG. 1, the pressing tool 13 includes a distinguishing mark in the form of a QR code 25. The same is also captured by the camera 20. Thereby it is possible to perform an automated identification of the pressing tool 13, since the QR code 25 stores information about the pressing tool 13. This information can be captured by the camera 20 and may be evaluated in an evaluation device.

According to the invention the camera 20 is oriented such that its image area 21 also captures the gap 15 between the pressing jaws 16 of the pressing tool 13. The gap 15 is in immediate proximity to the compressed pipe 14. The gap 15 is closed only if both pressing jaws 16 have moved towards each other to the full extent. If the pressing tool 13 and the press fitting 16 match, the gap 15 can be closed completely only if the pressing has been performed to the end. Thus, the closed gap 15 is a criterion by which a proper pressing can be judged. Since the camera 20 captures the gap 15, this may be evaluated at a later time if the captured data are stored.

Figure 2:
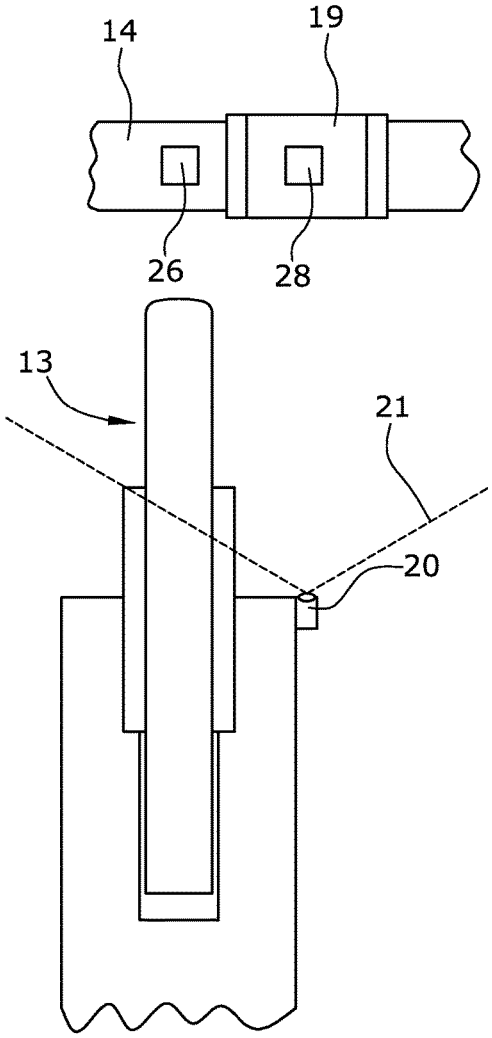
FIG. 2 is a top plan view of a pressing device.

The pressing device further includes a RFID reader 23. The press fitting 19 is equipped with a RFID element 28 and the pipe 14 is also equipped with a RFID element 26, as illustrated in FIG. 2. The RFID reader 23 captures both elements and can thereby identify both the pipe 14 and the press fitting 19.

Figure 3:
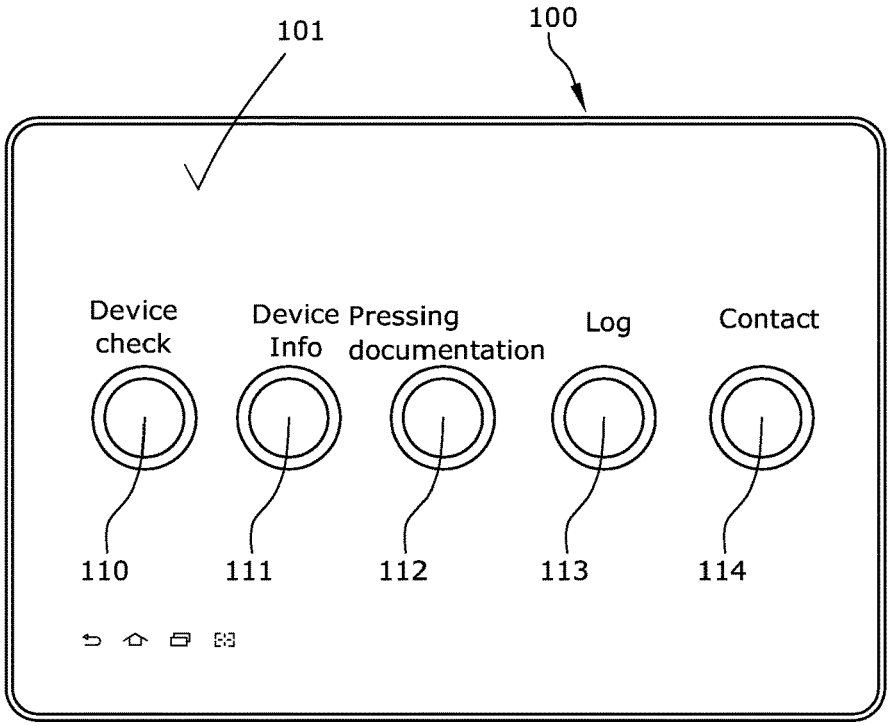
FIG. 3 shows an external means including a display device, a memory device and an evaluation device.

As can be seen in FIG. 1, the pressing device further includes a transmitter unit 30 that transmits the data captured by the camera 20, as well as by the other data capturing elements to a tablet PC via Bluetooth, which serves as an external memory device with an evaluation device and a display device. FIG. 3 illustrates the tablet PC 100 having a display device 101. As commonly known, the display device 101 of tablet PCs at the same time serves as an operating element. Information about a respective pressing operation is retrieved via the operating element 110. Here, the information result from the captured data transmitted from the pressing device by the transmitter unit 30 via Bluetooth. An overview of the captured data of the pressing operations stored in the memory device is reached via the operating element 111. Information that results from the captured device-specific data is retrieved via the operating element 112. The check of the proper functionality of the pressing device is accessed via the operating element 113.

Figure 4:
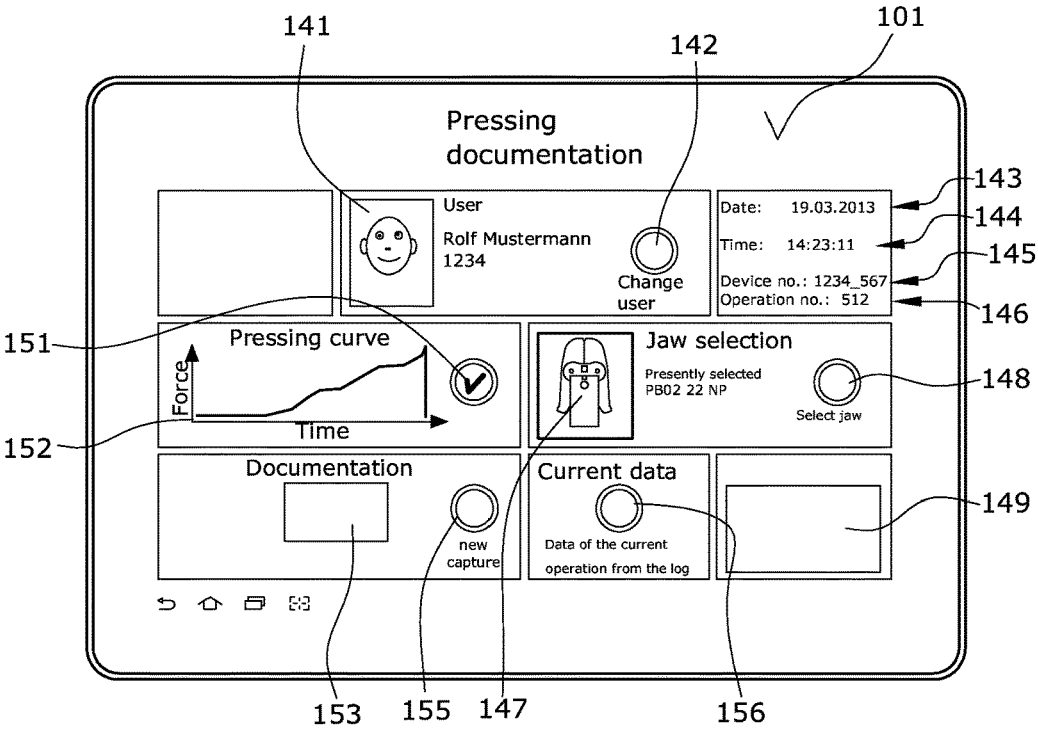
FIG. 4 shows an external device with displayed captured data of a pressing operation.

The operating element 110 allows for the retrieval of captured data specific to a pressing operation. FIG. 4 illustrates a display device 101. An image of the user 145 that has performed the pressing operation is displayed thereon. User-specific data regarding the respective pressing operations can be captured and/or inputted via the operating element 142. It may be provided, for instance, that a picture of the user is taken and stored via the operating element 142. The date 143, the time 144 and the serial number 145 of the device, as well as a consecutive number for the respective pressing operation 146 are displayed and stored as the data specific to the pressing operation. Besides that, the pressing tool used is displayed at 147 and stored. Via the operating element 148, another pressing tool 13 may be selected or be captured via the camera 20 or the RFID reader 23. The location of the pressing operation may be detected via a built-in GPS sensor. The same is illustrated at 149. Further, the force path over time is captured as data specific to the pressing operation. The same is displayed at 152 and stored. At the same time, an evaluation is made wherein the force path is compared to a predetermined force path. The result is displayed by element 151. The force path is determined in particular from the rotary speed and/or the current flow and/or the hydraulic pressure. The pipe 14 and the press fitting 19 are captured by the camera 20. The image captured is displayed at 153 and stored. A new image of the press fitting 19 and the pipe 14 may be generated via the operating element 155.

Data capturing may be started either by the user via an operating element at the tablet PC 100 or by simply calling the capturing control at the external device. However, data capturing may also be started in an automated manner upon energizing the pressing device and/or upon actuating the operating element 17. All data thus captured and illustrated in FIG. 4 relate to a single pressing operation. These data are stored and are allocated by the operation number 146. An overview of all stored pressing operations can be accessed via the operating element 156.

Figure 5:
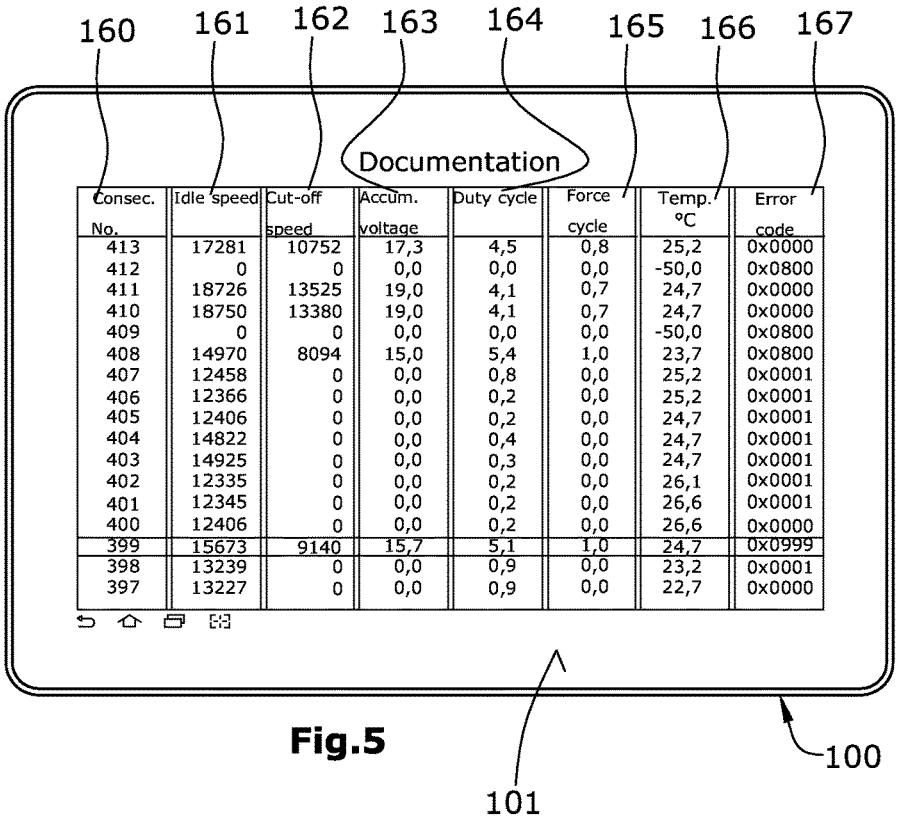
FIG. 5 shows an external device with displayed, captured and stored data of a plurality of pressing operations.
Figure 6:
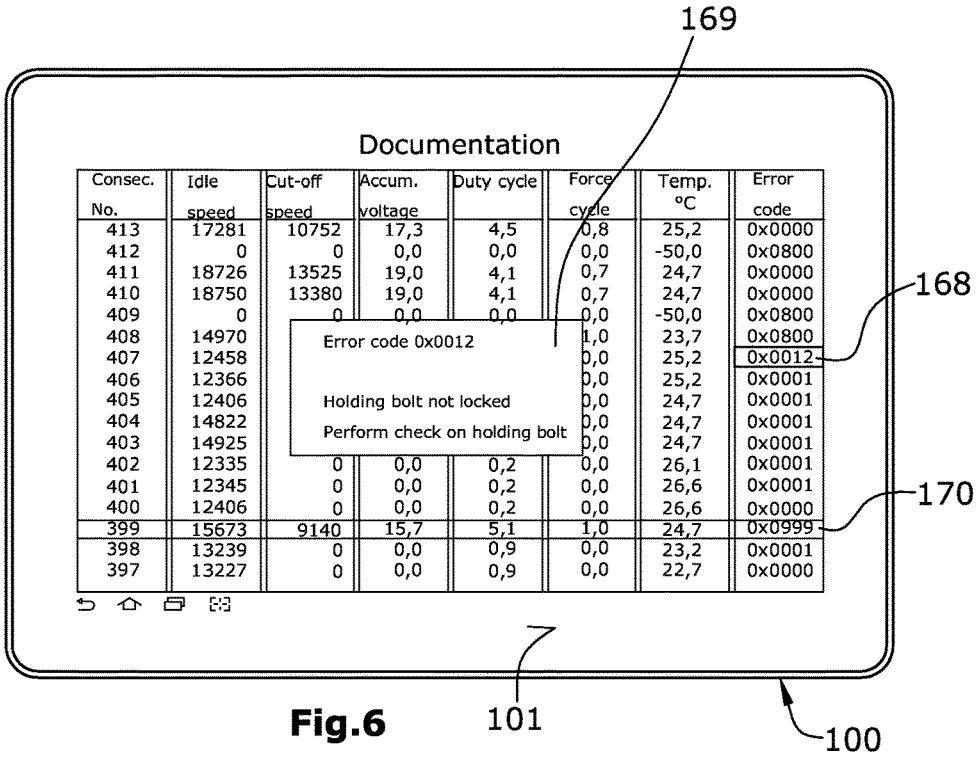
FIG. 6 shows an external device with displayed and stored captured data of a plurality of pressing operations, with an error having been generated for one of these.

In FIG. 5 the display device 101 of the tablet PC 100 shows an overview over a plurality stored pressing operations. These can be identified by the consecutive number 160. A plurality of captured data can be displayed for each pressing operation. FIG. 5 illustrates a selection. This selection is restricted to displaying the idle speed 161, the cutoff speed 162, the accumulator voltage 163, the duty cycle 164, the force cycle 165, the temperature during the pressing operation 166 and an associated error code 167 that includes possible errors during the pressing operation. For a better identification, individual pressing operations may be provided with color codes. If an error should occur thereafter, the line related to the pressing operation is displayed in a signal color or highlighted 170 in some other way. If an error is generated during evaluation, this error is assigned a different error code. When a specific error code 168 assigned to a specific pressing operation is selected, the user receives clear text information 169 about the error that has occurred, as illustrated in an exemplary manner in FIG. 6. In this manner a user can judge in a simple manner whether the pressing operation was performed correctly or not. Thereby, error sources can be determined earlier and faulty pressing operations can be corrected faster or can be prevented.

Figure 7:
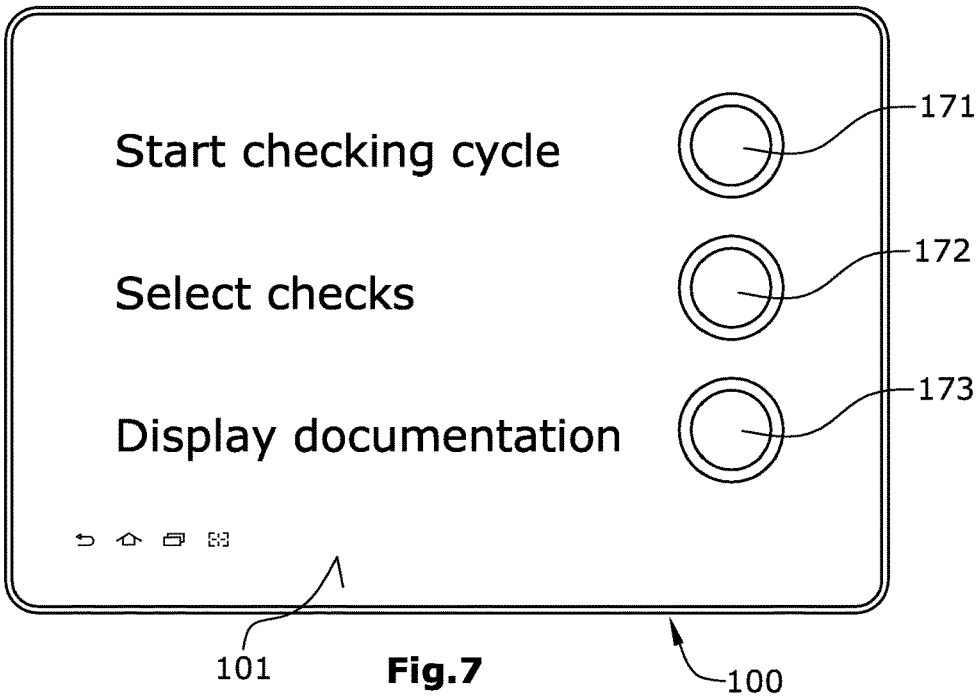
FIG. 7 shows an external device for starting a checking cycle.

The display on the display device 101 of the tablet PC 100, illustrated in FIG. 7, is reached via the operating element 113. Here, the checking cycle can be started via the operating element 171. Further, a user may select individual checks via the operating element 172. The user returns to the stored documentation of the individual pressing operations via the further operating element 173.

Figure 8:
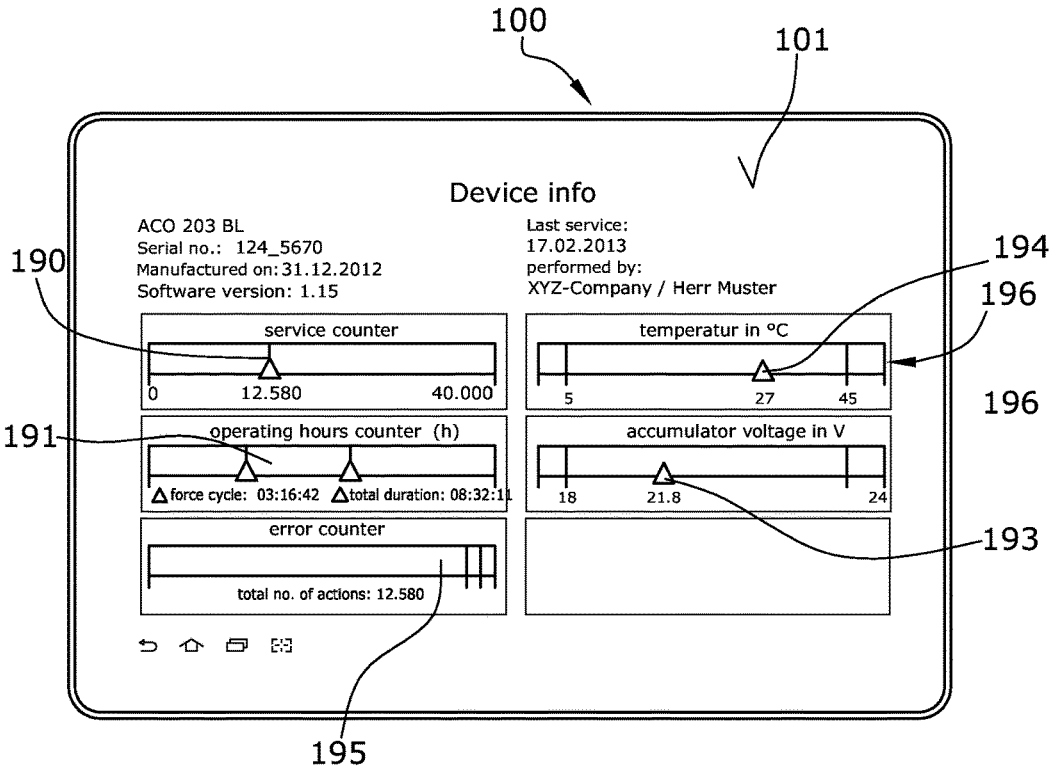
FIG. 8 shows an external device with displayed captured data.

Via the operating element 113, the user reaches the display of the device-specific captured data. Here, the number of pressing operations 190, the operating hours 191, the temperature in the pressing device 194 and the voltage in the accumulator unit 193 can be displayed, for example. Further, the errors 195 that have occurred are counted. In this regard, a differentiation is made between flawless, i.e. proper pressing operations, minor errors and major errors where a proper pressing operation could not be achieved. Even if in FIG. 8 no evaluation, i.e. a comparison to predetermined values, is performed, the user may still visually compare the displayed values to a predetermined value range. For example, a value range of 5° C. to 45° C. is indicated for the temperature, in which range the pressing device functions properly. The display illustrated here also is a selection from the device-specific captured data. Other captured data may be added and/or removed, in order to allow for a comprehensive judgment on the proper functionality of the pressing device by the user.

Figure 9:
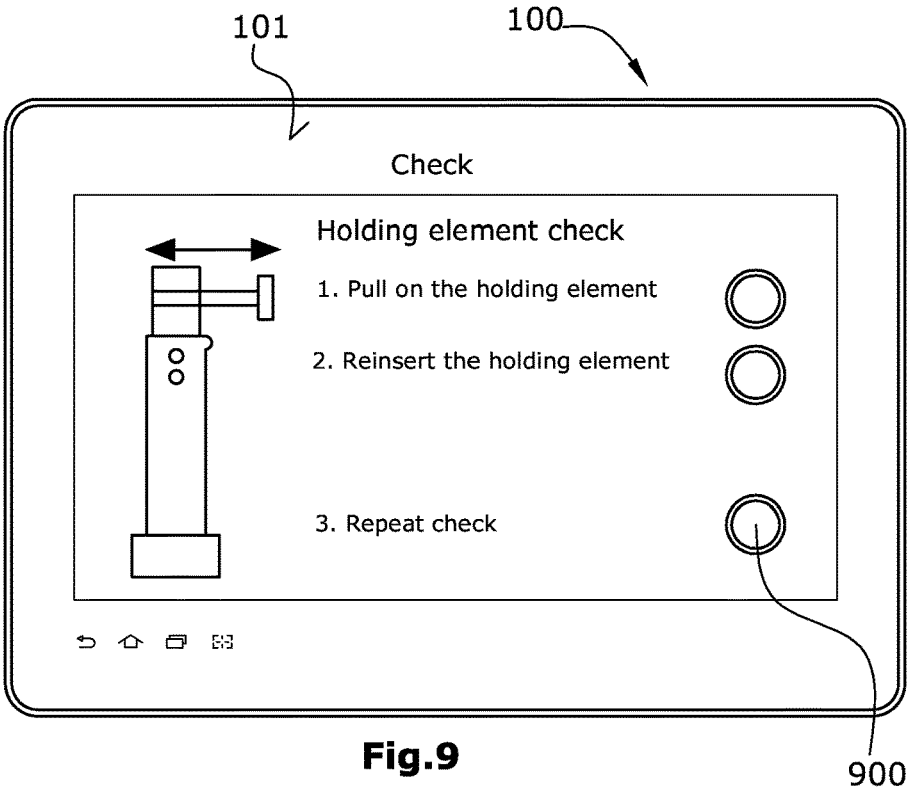
FIG. 9 shows an external device with a displayed evaluation of the check on the position of the holding element and instructions for a counter measure.

An automated evaluation by an evaluation device is also possible, the evaluation device comparing the data captured to respective predetermined value ranges and displaying only the result of this evaluation. Thereby, a misinterpretation by the user becomes impossible. If, for example, the evaluation of the position of the holding element indicates an error, the user will reach a screen illustrated in FIG. 9. Here, the user is given step-by-step instructions in order to remove the error. The holding element may be checked again via the operating element 900. It is thereby ensured that the pressing tool is always securely connected with the drive unit.

Figure 10:
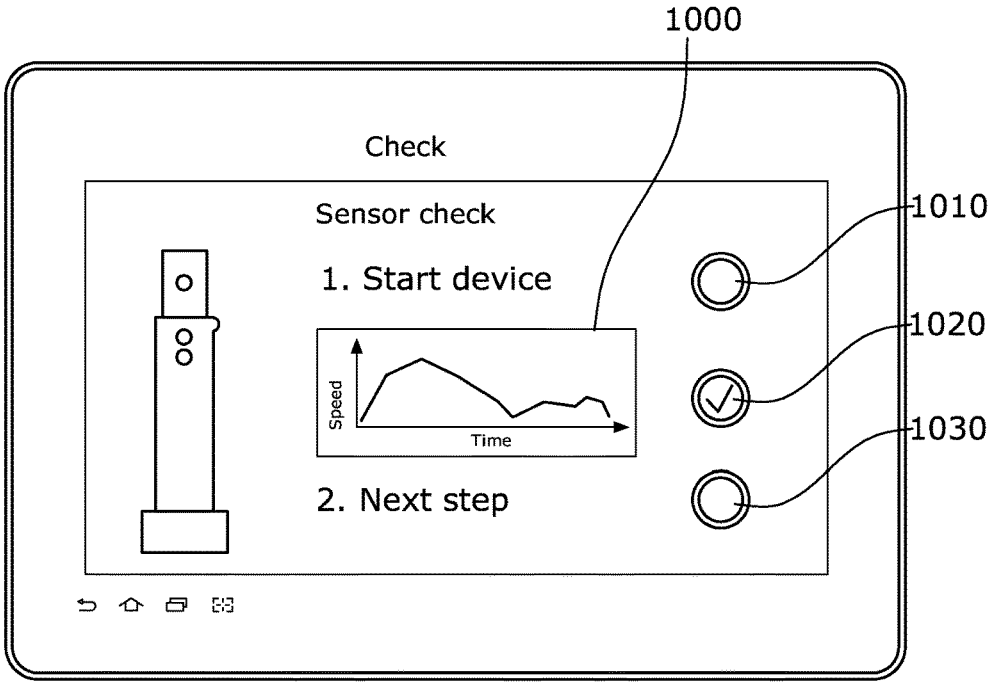
FIG. 10 shows an external device with the detection of the rotary speed sensor check displayed and evaluated.

If the check of the rotary speed sensor is selected 172 and the checking cycle is started 171, the user reaches the display illustrated in FIG. 10. For a check of the rotary sped sensor, the pressing device performs a pressing operation without pressing tool. The user starts the pressing operation via the operating element 17. The rotary speed of the electric motor is detected over the duration of the pressing operation via a data capturing element designed as a rotary speed sensor. The data captured are displayed on the display element 1000. Thereafter, for the purpose of evaluation, the rotary speed or the course of the rotary speed is compared to a course predefined by the manufacturer. If the rotary speed is within a range around the predefined course, the rotary speed sensor is functional. In addition, the signal quality of the rotary speed sensor may be checked. The result of these evaluations is displayed by the element 1020. The user returns to the previous screens via the operating element 1030.

Likewise, a automated evaluation is possible for checking the pressing force, for which a pressing tool is installed first.

Figure 11:
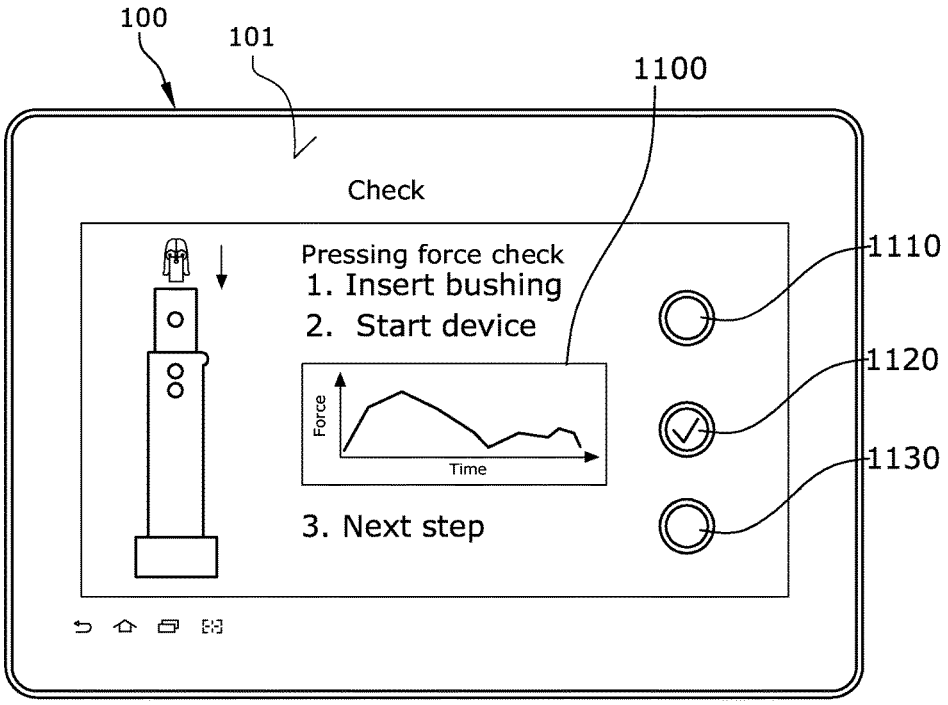
FIG. 11 shows an external device with displayed captured data and evaluation of the pressing force check.

In FIG. 11 a display on the display device 101 for performing the pressing force check is illustrated. The device is started via the operating element 1110, whereupon the device performs a pressing operation with a pressing tool. The rotary speed and the current flow and/or the hydraulic pressure are captured over the duration of the pressing operation. The pressing force can be determined from these values. The course of the pressing force 1100 is displayed. For the evaluation, the pressing force determined is compared to a predefined course of the pressing force. Likewise, it is possible to compare both the rotary speed detected and the course of the current flow or of the hydraulic pressure to a respective predefined course. If the courses are within a range around the respective predefined course, sufficient pressing force is generated and the pressing device can be used to perform a proper pressing operation. The result of the evaluation is displayed by the element 1120. The user will reach the previous screen via the operating element 1130.

Figure 12:
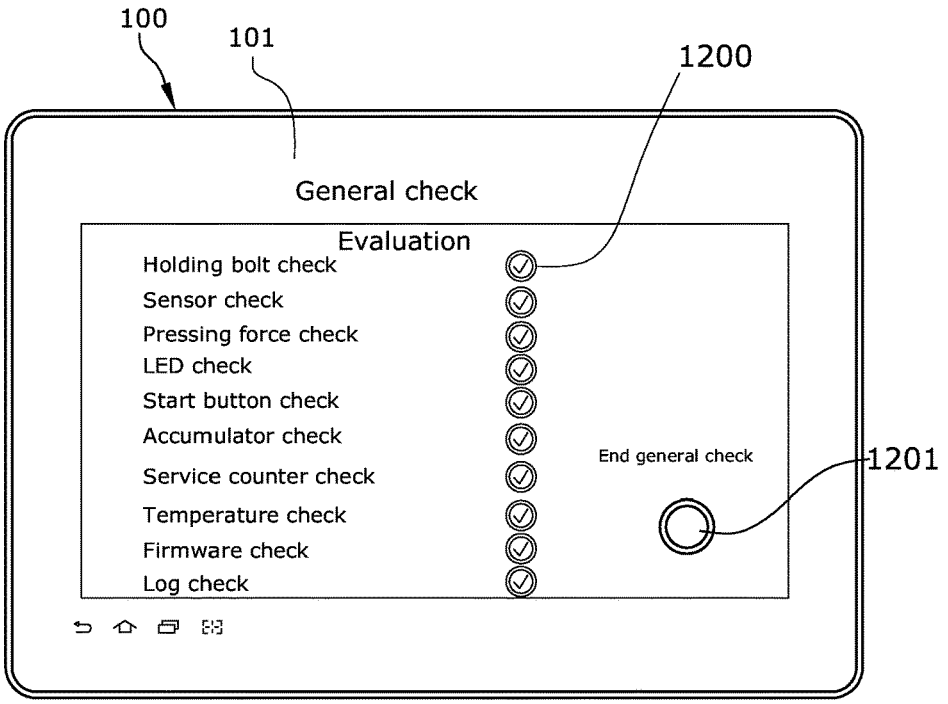
FIG. 12 shows an external device displaying a summary of the evaluations.

In FIG. 12 a summary of the valuation of various checks is displayed. If checks are selected via the operating element 172, they are displayed in this summary after the checking cycle has been performed. The result of the respective checks 1200 is also displayed. Via the operating element 1201, the user returns to the screen illustrated in FIG. 3. The summary allows a user to judge in a simple manner whether the pressing device functions properly. It is thereby ensured that pressing operations performed are also performed properly. Since the checks are also stored in a memory device, it is possible to provide evidence on the proper functioning of the pressing device.

Via the operating element 114 a selection of the captured data of individual or all checking cycles and/or of individual or all pressing operations performed can be transmitted to the manufacturer by means of an Internet connection of the tablet PC. In this context, an evaluation may have been made already in the external evaluation means. Likewise, the evaluation of the data captured may be made by the manufacturer. The manufacturer is thus given the possibility to instruct the user remotely on removing an error.

The invention claimed is:

1. A handheld pressing device for joining two work pieces by pressing, comprising:

a pressing tool with a plurality of pressing jaws;

a converting device connected to the pressing tool and driven by an electric motor;

at least one data capturing element comprising a camera, the camera oriented such that the camera captures the pressing tool and a gap between the plurality of pressing jaws; and an external evaluation device connected to the at least one data capturing element and configured to evaluate a quality of a pressing procedure based at least partly on the gap between the plurality of pressing jaws;

wherein the electric motor and the converting device are at least partially enclosed by a housing.

2. The pressing device of claim 1, wherein the camera is oriented such that the camera captures a QR code or a distinguishing mark on the pressing tool so as to identify the pressing tool.

3. The pressing device of claim 1, wherein the camera is oriented such that the camera captures the work pieces or a distinguishing mark provided thereon, in order to identify the work pieces.

4. The pressing device of claim 1, wherein at least one data capturing element of the at least one data capturing element is an RFID reader.

5. The pressing device of claim 4, further comprising an RFID element adapted to be read by the RFID reader.

6. The pressing device of claim 4, wherein at least one work piece comprises an RFID element adapted to be read by the RFID reader.

7. The pressing device of claim 1, wherein at least one data capturing element is arranged in the housing of the pressing device.

8. The pressing device of claim 1, further comprising a memory device for storing the captured data.

9. The pressing device of claim 1, further comprising a transmitter unit adapted to be connected to an external memory device, the external evaluation device, an external display device, or an external memory device, the external evaluation device, and an external display device in order to transmit the captured data to the external memory device, the external evaluation device, the external display device, or the external memory device, the external evaluation device, and the external display device.

10. The pressing device of claim 9, wherein the transmitter unit is connected to the external memory device, the external evaluation device, the external display device, or the external memory device, the external evaluation device, and the external display device in a wireless manner by WLAN, Bluetooth, infrared transmission or radio transmission.

11. The pressing device of claim 1, wherein a motor control triggers data capturing of the at least one data capturing element.

12. A method for documenting pressing operations performed on two work pieces, comprising:

performing a pressing operation with the handheld pressing device of claim 1;

when a documentation capturing is started, capturing data with the at least one data capturing element during each pressing operation that is specific to a device, a pressing operation, a user, or a device, a pressing operation, and a user; and storing the captured data in a memory device, wherein the captured data is associated to a specific pressing operation.

13. The method of claim 12, wherein the camera captures the pressing tool, a work piece, or the pressing tool and the work piece after the pressing operation, or a gap between the pressing jaws of the pressing tool after the pressing operation as the data specific to the pressing operation.

14. The method of claim 12, wherein the camera captures the user as user-specific data.

15. The method of claim 12, wherein the pressing device comprises more than one data capturing element.

16. The method of claim 12, wherein the data specific to the device captured is at least one of the following:

a type or a serial number of the pressing device, a type, a serial number, or a nominal size of a pressing tool of the pressing device, and control data about the pressing device, such as duty cycle, operating temperature, accumulator voltage of an accumulator unit, a number of pressing operations made or control data about the pressing tool.

17. The method of claim 12, wherein the captured data specific to the pressing operation is at least one of the following: a date or a time of the pressing operation, a duration of the pressing operation, a pressing path, a maximum pressing force or cut-off speed, a course of the pressing force over the pressing path, and data about whether a pressing operation has been performed properly or not.

18. The method of claim 12, wherein a name or a code is captured as the data specific to the user.

19. The method of claim 12, wherein an RFID reader is used to capture data.

20. The method of claim 12, wherein a GPS sensor or another positioning element is used via mobile radio or WLAN, so as to capture a location of a pressing operation as data specific to a pressing operation.

21. The method of claim 12, wherein the memory device is arranged in the pressing device.

22. The method of claim 12, wherein the captured data is transmitted in a wireless manner via WLAN, Bluetooth, IR transmission or radio transmission to an external memory device, an external display device, or an external memory device and an external display device.

23. A method for checking a proper functionality of a handheld pressing device, comprising:

providing the handheld pressing device of claim 1, wherein the pressing tool is connected to the converting device via a holder element, and the electric motor is operated via an operating element;

starting a checking cycle;

capturing data by data capturing elements; and displaying the captured data on an external display device.

24. The method of claim 23, wherein the captured data includes at least one of the following: a number of operating hours, a number of pressing operations, a temperature in the pressing device, and a voltage of an accumulator unit.

25. The method of claim 23, wherein the captured data includes a position of a holding element.

26. The method of claim 23, wherein the captured data includes a rotary speed of the electric motor without load.

27. The method of claim 23, wherein the captured data includes a pressing force, a course thereof during a pressing operation, or a pressing force and a course thereof during a pressing operation.

28. The method of claim 23, wherein a functionality of one or a plurality of status lights of the pressing device or a functionality of the operating element is captured.

29. The method of claim 23, wherein the captured data is stored in a memory device in the pressing device.

30. The method of claim 23, wherein the captured data is transferred to at least one of the following: the external display device, the external evaluation device, and an external memory device, in a wireless manner via WLAN, Bluetooth, infrared transmission or radio transmission.

31. The method of claim 30, further comprising displaying a performed evaluation on the external display device.

32. The method of claim 31, wherein, for the purpose of evaluation, the captured data is compared to at least one predefined value range and, if the captured data does not fall within the at least one predefined value range, an error is generated.

33. The method of claim 31, wherein the pressing device is started without a pressing tool, a rotary speed, a signal quality of a rotary speed sensor, or a rotary speed and a signal quality of a rotary speed sensor is captured, the captured rotary speed is compared to a predefined value range for evaluation, and, if the rotary speed does not fall within the predefined value range or the signal quality of the rotary speed sensor is faulty, an error is generated.

34. The method of claim 31, wherein a pressing tool is inserted into the pressing device, a pressing operation is performed with the pressing tool, at least one of the following is captured over a duration of the pressing operation: a rotary speed, a current flow, and a hydraulic pressure, the captured rotary speed, the captured current flow, or the hydraulic pressure are compared to a predefined course for evaluation purposes, and, if the data thus captured does not fall within a range around the predefined course, an error is generated.

35. The method of claim 31, wherein, if an error has been generated, the error is displayed on the external display device, is stored by the external memory device, or the error is displayed on the external display device and is stored by the external memory device.

* * * * *